US005457250A

United States Patent [19]

Gerhardus et al.

[11] Patent Number: 5,457,250

[45] Date of Patent: Oct. 10, 1995

[54] PROCESS FOR THE PREPARATION OF SYNTHESIS GAS

[75] Inventors: Ulrich Gerhardus, Oberhausen; Horst Hanke, Wesel; Josef Hibbel, Oberhausen; Norbert Leder, Oberhausen; Klaus Poloszyk, Dorsten; Heinz Scheve, Oberhausen; Volkmar Schmidt, Oberhausen, all of Germany

[73] Assignee: Hoechst Aktiengesellschaft, Germany

[21] Appl. No.: 291,272

[22] Filed: Aug. 16, 1994

[30] Foreign Application Priority Data

Aug. 21, 1993 [DE] Germany ..... 43 28 188.5

[51] Int. Cl.[6] ..... C07C 1/00; C10G 51/02

[52] U.S. Cl. ..... 585/241; 208/67

[58] Field of Search ..... 585/241, 240; 208/67

[56] References Cited

U.S. PATENT DOCUMENTS

| | | | |
|---|---|---|---|
| 4,108,730 | 8/1978 | Chen et al. | 201/2.5 |
| 4,725,349 | 2/1988 | Okamoto et al. | 208/130 |
| 5,061,363 | 10/1991 | Farcasin et al. | 585/241 |
| 5,158,982 | 10/1992 | Stapp | 585/241 |

FOREIGN PATENT DOCUMENTS

| | | | |
|---|---|---|---|
| 2169965 | 9/1973 | France | C10G 1/02 |
| 2357630 | 2/1978 | France | C10G 11/00 |
| 63-260981 | 10/1988 | Japan . | |

*Primary Examiner*—Sharon A. Gibson
*Assistant Examiner*—Nhat D. Phan
*Attorney, Agent, or Firm*—Jordan B. Bierman

[57] ABSTRACT

Plastic wastes are thermally cracked to give primarily liquid products which are transformed into synthesis gas by partial oxidation.

19 Claims, 1 Drawing Sheet

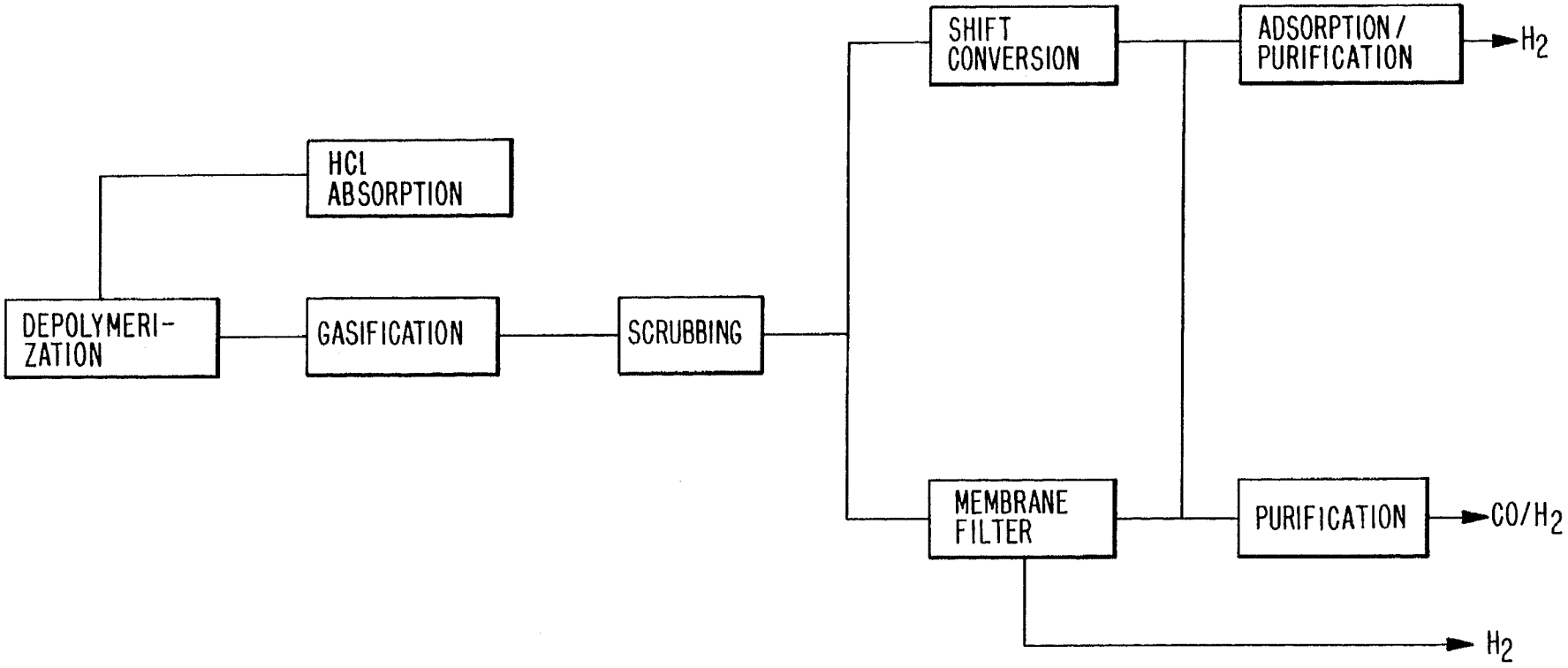
ADSORPTION/ PURIFICATION
$H_2$
SHIFT CONVERSION
PURIFICATION
$CO/H_2$
MEMBRANE FILTER
$H_2$
SCRUBBING
HCL ABSORPTION
GASIFICATION
DEPOLYMERI- ZATION

PROCESS FOR THE PREPARATION OF SYNTHESIS GAS

This Application claims the priority of German Application P 43 28 188.5, filed Aug. 21, 1993.

The invention relates to a process for the conversion of plastic wastes into synthesis gas which can be used as a raw material for chemical syntheses.

BACKGROUND OF THE INVENTION

One of the most urgent environmental problems facing expert circles is the disposal of wastes, including those made of plastic. Heretofore, such materials were mixed with other wastes and stored in landfills, but this has proven to be a questionable procedure because it does not take into account the long-term effect on ground-water and soil. Attempts are made to avoid such environmental pollution by storage in special landfills but, because there are only a limited number of appropriate discharge sites, disposal of the wastes in an environmentally neutral manner is actually only being shifted to the future.

Therefore, many attempts have been made recently to develop processes for reprocessing such wastes. They do not have the sole aim of protecting the environment, but frequently include the recovery of utilizable products from materials which are no longer useful for their original designated purpose.

The reprocessing of used or off-specification plastics to give reusable original material fails in most cases because the wastes contain plastics of different material compositions. It is easily seen that such mixtures generally cannot be reprocessed to give the original material or an equivalent thereof. The separation of the mixtures into their individual components fails because of the difficulty of identifying them. Moreover, only in exceptional cases can starting material of the original quality be recovered from wastes of even identical plastics, since the necessary chemical and/or physical treatment steps change the molecular structure of the polymers and thus their properties.

Plastic wastes can be incinerated only under conditions which ensure that no pollutants pass into the atmosphere. This prerequirement is satisfied only in exceptional cases, since the plastics frequently include chlorine-, sulfur-, or nitrogen-containing constituents, as well as heavy metals, all of which lead to undesirable combustion products. Dust removal and flue gas scrubbing (and sometimes special combustion apparatus) are then unavoidable. Transport and metering problems can arise if the wastes also contain non-combustible and non-melting foreign materials. Moreover, economic reasons argue against burning high-grade processing products of petrochemical raw materials, just as they argue against burning their raw materials, i.e. petroleum and petroleum products.

Instead of burning them, plastics which are no longer utilizable have also been thermally cracked. The processes developed therefor take many forms. Thus, by the breakdown of polyethylene at 400° to 450° C., a gasoline/kerosene mixture is obtained (C.A. Vol. 76, 1972, 158024 q). This process can also be carried out in the presence of nickel catalysts (Chem. Ind. XXIII, 1971, 630). The cracking of carbon-containing organic wastes of synthetic or primarily synthetic origin is carried out by the process of EP-A-291 698 under hydrogenating conditions and predominantly yields hydrocarbon fractions in the gasoline and middle oil (diesel oil) boiling range. Plastic and rubber wastes are thermally cracked by the process described in DE-C-2 205 001 at 250° to 450° C. in the presence of an auxiliary phase liquid at the reaction temperature. Over 90% liquid hydrocarbons are produced and, in lesser amounts, soot.

An obvious desirable aim of the thermal treatment is the conversion of the plastics into liquid fuels, which can easily be transported, metered, and homogeneously distributed in the combustion air to ensure smoke-free and soot-free combustion. Prior use of the hydrocarbons, e.g. as solvents, extractants, or as cleaning agents is not excluded in this case.

Important disadvantages of the known processes are the requirement to very substantially degrade the plastics, the necessity of maintaining corresponding temperatures and residence times, and the need for complex separation of the solids, such as inorganic or organic pigments, opacifiers, and fillers, which are frequently present in the plastics.

SUMMARY OF THE INVENTION

The object of the invention is to convert plastic wastes into industrially utilizable materials. In this case, solids incorporated into the plastics must be concentrated in the treatment process and be produced free from organic constituents so that they can be disposed of in an environmentally acceptable manner.

This object is achieved by a process for the preparation of synthesis gas from plastic wastes. It comprises thermally cracking the wastes primarily to produce liquid products, and transforming the liquid cracking products by partial oxidation into synthesis gas.

The term plastic wastes in the context of the novel process is to be understood very broadly. It includes uniform substances and mixtures of substances, regardless of their origin and composition. Depending on their thermal behavior, the wastes are derived from thermoplastic or thermosetting plastics. Such wastes can be plastics which have been used for packaging purposes; they also include materials used e.g. in the building, electrical, or textile industry, as well as in machine and vehicle construction. Those which have been processed to give articles of daily use, such as domestic and sporting equipment or toys, may also be used as the starting material for the present invention. Plastic wastes are also faulty batches and unutilizable remains and residues from production and processing. Therefore, plastic wastes can, in brief, be any plastic material which is not regenerated or supplied to another economic utilization. Wastes comprising, for example, polyolefins; vinyl resins such as polyvinyl chloride, polyvinyl acetate, and polyvinyl alcohol; polystyrenes; polycarbonates; polymethylene oxides; polyacrylates; polyurethanes; polyamides; polyester resins; and hardened epoxide resins can all be processed by the present invention. The process can be carried out with particular simplicity with thermoplastics.

BRIEF DESCRIPTION OF THE DRAWING

In the accompanying drawing, made a part hereof,

The single Figure is a flow diagram of the inventive process.

DETAILED DESCRIPTION OF THE INVENTION

According to the invention, the feedstock, from which coarse impurities such as metals, glass, and ceramics have been mechanically separated, is thermally degraded to give low-molecular fragments. All known processes, which preferentially yield liquid decomposition products, and gaseous decomposition products and/or soot only in small amounts, are fundamentally suitable for this process step. The cracking of the polymeric compounds can be carried out in the presence or absence of hydrogen. Subsequent hydrogenation of the cracking products is likewise possible, but it is not absolutely necessary to work under hydrogenating conditions in any step of the thermal pretreatment of the wastes. The choice of the process suitable for the thermal degradation of the plastics is therefore substantially dependent on the particular conditions.

The depolymerization of the plastic wastes not only leads to easily meterable and homogeneous liquid products, it also effects, in particular, a dechlorination of the chlorine-containing plastics frequently present in the wastes. The halogen is eliminated as hydrogen chloride which is scrubbed out of the gaseous degradation products in a known manner. The liquid cracking products contain chlorine in small amounts only which can be tolerated in the subsequent gasification.

Thermal treatment of the plastic wastes at temperatures between 250° and 450° C. using an auxiliary phase liquid at the reaction temperature has proven to be particularly suitable (cf. DE-C-2 205 001). This auxiliary phase serves, in particular, to transfer the heat to the feedstocks in the cracking reactor. Furthermore, it promotes the thermal degradation by allowing the feedstocks in many cases to swell in a gel-like manner. Those substances have been particularly successfully employed as auxiliary phases which at least partially dissolve, at the given reaction temperature, the waste products themselves and the cracking products thereof. Natural or synthetic waxy hydrocarbons, in addition polyglycols and, in particular, the liquid degradation products of the plastic wastes have proven to be useful.

The degradation of the wastes to be treated is promoted by mechanically comminuting them before thermal cracking. Moreover, the degradation can be accelerated by addition of suitable catalysts. Thus, wastes which contain principally polyolefins can easily be cleaved into low-molecular fragments at elevated temperature in the presence of manganese, vanadium, copper, chromium, molybdenum, or tungsten compounds. The catalytically active metals may already be present in the plastics in the form of ingredients, so that their further addition is superfluous.

The conversion of the high-molecular feedstocks is carried out in conventional reactors, e.g. in closed tanks provided with stirrers and a heating apparatus. A single stage is conventionally employed. In particular, when corrosive and/or environmentally unacceptable gases develop in the reprocessing of wastes, it is advisable to carry out the cracking process in two or more stages, the cracking generally not being operated at the same temperature in the individual stages, but rather with temperatures increasing from stage to stage. Thus, it has proven to be useful, when using chlorine-containing polymers, initially to dry water-wet plastics at a moderate temperature which does not yet cause HCl elimination to avoid corrosive stress of aqueous hydrogen chloride on the reactor materials. Only after drying is the temperature increased to the extent that the polymers crack and hydrogen chloride is formed. The dechlorination can be completed in an additional stage by further increase of temperature and residence time. The stepwise thermal degradation of chlorine-containing polymeric substances makes it possible, by choice of the reaction temperatures, for cracking products developing corrosive and/or environmentally unacceptable gases to accumulate preferably in the first cracking stage, so that, in the subsequent separation of the gases harmful to the environment, only some of the cracking products must be fed to a purification apparatus. However, it must be emphasized that even plastic wastes which contain chlorine in an order of magnitude of about 5% by weight, can be converted by the inventive process into liquid cracking products, the chlorine content of which is only a few 100 ppm.

The cracking products boil in the range of straight-run gasoline and the middle distillates and also have the viscosity of these petroleum fractions. They can therefore be pumped by conventional apparatus.

Some of the hydrocarbons formed in the cracking leave the reactor as vapors mixed with the hydrogen chloride and small amounts of other cracking gases such as carbon monoxide, hydrogen, nitrogen, and ammonia. They are recovered as an ash-free condensate from the gaseous mixture by partial condensation. The condensate is a raw material suitable for further processing, e.g. to naphtha. The hydrogen chlorine-containing gas phase can be transformed into (for example) about 30% strength hydrochloric acid.

The remaining portion of the cracking product (which contains all of the ash) is discharged in the liquid state and, alone or in a mixture with other raw materials, such as naphtha, is converted by steam and oxygen to synthesis gas.

This reaction can likewise take place by known processes. Suitable processes are, in particular, those which permit a problem-free separation of the ash and its recovery without foreign admixtures. Achieving this object requires a carbon conversion rate in the reactor which is as high as possible to avoid discharge of soot together with the ash. In addition, particular cooling apparatus must be provided for the crude gas which carries along the liquid ash. Direct cooling with water in a quench cooler or a system composed of a radiant cooler and convection cooler have proven to be useful. The cooling stage is followed by water scrubbers in which the last ash residues are removed. The ash can be stored in landfills or further processed to give metals.

A process which satisfies the requirements outlined above, in particular with regard to avoidance of pollutants, is described, e.g. in EP-A-515 950. It features oxidizing the feedstock under conditions which lead to the formation of about 0.1% to about 0.3% by weight of soot, based on the carbon in the hydrocarbons used. This procedure can also be successfully applied to the conversion of the cracking products of plastic wastes into carbon monoxide/hydrogen mixtures. The soot level in the ashes is adjusted in known manner via the amount of oxygen fed; moreover, the use of a specially designed burner is advisable (cf. e.g. EP-B- 95 103).

The gasification itself is carried out at temperatures between 1100° and 1500° C. and at pressures of 1 to 10 MPa. The crude gas leaving the gasification reactor at a temperature of 1300° to 1500° C., apart from soot in the amount stated, contains metals and/or metal compounds in liquid form. It is first precooled in a radiant cooler to 500° to 1000° C., a temperature range in which the metallic impurities solidify without significant contact with the cooler walls. Some of the solid particles are deposited in the water sump of the radiant cooler and are discharged from there. For further cooling to 150° to 300° C., preferably 260° to 280° C., the crude gas, still containing residual proportions of fine metal and soot particles, is passed into a convection cooler. Since the impurities entrained by the gas have already solidified in the radiant cooler, they do not impair the efficiency of the convection cooler by obstructing the flow paths and deposits on the exchange surfaces. The virtually complete separation of the solids is carried out by scrubbing the gas with water. This step of the process is expediently carried out with the aid of wet separators of the prior art, e.g. with water-percolated packed towers which can also be employed in connection with Venturi scrubbers. The ash is recovered by mechanical separation, e.g. filtration, from the scrubbing water.

The carbon monoxide/hydrogen mixture obtained by gasification of the depolymerized plastic wastes can be used directly as a starting material for chemical reactions such as oxosynthesis. In accordance with the composition of plastic wastes, the C/H ratio of their cracking products is lower than that of heavy heating oils, the conventional raw materials for synthesis gas production. The $CO/H_2$ ratio of 1:1 required for certain applications (e.g. the oxo process) is therefore not always achieved. In order to decrease the hydrogen proportion, a hydrogen-rich fraction can be separated off from the solids-free crude gas in a membrane unit, which hydrogen-rich fraction is burnt or further processed by converting to give pure hydrogen. Of course, all of the gas mixture can clearly alternatively be transformed into hydrogen by shift conversion.

The following Example is to illustrate the invention, not to limit it.

EXAMPLE

Recycled packaging material comprising plastic material with a water content of 2.5 percent by weight and also containing 3.3 percent by weight of chlorine is suspended in a liquid auxiliary phase which is obtained by the thermal cracking of plastic waste material, and heated to 130° C. for the separation of water. Thereupon the suspension comprising the plastic material is transferred to the cracking reactor in which the depolymerization of the starting material takes place at approximately 350° C. and a residence time of approximately 4 hours. Gaseous cracking products are cooled to approximately 30° C. and supplied to an appropriate absorption system for separating hydrogen chloride. The liquid product has the following composition:

| | | |
|---|---|---|
| C | = | 84.3 percent by weight |
| H | = | 12.0 percent by weight |
| N | = | 0.4 percent by weight |
| S | = | 1.3 percent by weight |
| ash | = | 2.0 percent by weight |

It contains 300 mg Cl/liter, has a density of 920 kg/m$^3$, and a viscosity of 404 mPa.s (at 90° C.).

A portion of the liquid cracking product is used as the auxiliary phase (suspension means) for the thermal cracking of further plastic waste material, and the rest is partially oxidized to water gas. To this end, the product is converted at approximately 1400° C. and a pressure of 4 MPa in known manner with oxygen and water vapor. To generate 1000 Nm$^2$ $CO/H_2$ mixture, 400 kg of the cracked product, 325 Nm$^3$ oxygen, and 110 Nm$^3$ water vapor are required. The raw gas comprises 43.8 percent by volume of CO, 48.6 percent by volume $H_2$, and 6.6 percent by volume of $CO_2$. The $CO/H_2$ ratio is approximately 0.9.

The novel process is shown in the drawing in the form of a flow diagram. Plastic wastes are degraded thermally in the depolymerization stage at temperatures which, depending on the process, are between 200° and 500° C., to give liquid products, the flowability of which roughly corresponds to that of heavy heating oils at the same temperature. The depolymerization is accompanied by the elimination of hydrogen chloride from chlorine-containing plastics, and the hydrogen chloride is scrubbed out of the gaseous reaction product with water and further processed in a known manner, e.g. to give 30% crude acid. In special cases, the hydrogen chloride can be neutralized in an alkaline scrubber.

The cracking is followed by the gasification, i.e. the partial oxidation of the depolymerized wastes with oxygen in the presence of steam. Chlorine-carbon compounds remaining in low concentrations in the cracking product do not impair this process step. The $CO/H_2$ mixture resulting therefrom is scrubbed with water to remove solids and HCl. If required, alkaline reagents, such as alkali metal carbonate or alkali metal hydroxide, are added. To prepare synthesis gas having a defined $CO/H_2$ ratio, differing from the composition of the crude gas, the crude gas is conducted through a membrane filter.

Instead of synthesis gas, hydrogen can be produced from the crude gas. For this purpose it is shift converted, the resulting $CO_2/H_2$ mixture is fed to a chemical/physical washing system. If $H_2$ of very high purity is to be produced, the outgoing $H_2$ stream is subjected to pressure swing adsorption.

While only a limited number of specific embodiments of the present invention have been expressly disclosed, it is, nonetheless, to be broadly construed and not to be limited except by the character of the claims appended hereto.

What we claim is:

1. A process for the preparation of synthesis gas from plastic wastes comprising thermally cracking said wastes to produce primarily liquid products, and partially oxidizing said liquid products.

2. The process of claim 1 wherein said thermal cracking takes place between 250° to 450° C.

3. The process of claim 2 wherein there is an auxiliary phase present which is liquid at said reaction temperature.

4. The process of claim 3 wherein said auxiliary phase is selected from the group consisting of natural waxy hydrocarbons, synthetic waxy hydrocarbons, polyglycols, said liquid products, and mixtures thereof.

5. The process of claim 4 wherein said auxiliary phase is said liquid products.

6. The process of claim 1 wherein said thermal cracking is carried out in the presence of catalysts.

7. The process of claim 1 wherein said thermal cracking is carried out in at least a first stage and a second stage.

8. The process of claim 7 wherein a second reaction temperature of said second,stage is higher than a first reaction temperature of said first stage.

9. The process of claim 8 wherein said plastic waste contains chlorine and said cracking yield hydrogen chloride.

10. The process of claim 9 wherein said hydrogen chloride is produced principally in said first stage.

11. The process of claim 8 wherein reaction temperatures increase in successive stages.

12. The process of claim 1 wherein said liquid products are partially oxidized at an oxidation temperature of 1100° to 1500° C. and an oxidation pressure of 1 to 10 MPa to produce crude gas.

13. The process of claim 1 wherein an amount of oxygen introduced to partially oxidize said liquid products is controlled so that 0.1% to 0.3% by weight of soot is formed, based on said liquid products.

14. The process of claim 12 wherein said crude gas is first cooled to 500° to 1000° C. and then cooled to 150° to 300° C. to produce cooled gas.

15. The process of claim 14 wherein said crude gas is first cooled in a radiant cooler and then cooled in a convection cooler.

16. The process of claim 14 wherein said cooled gas is scrubbed with water to remove ash therefrom to form purified gas comprising CO and $H_2$.

17. The process of claim 16 wherein said ash is separated from said water.

18. The process of claim 16 wherein said purified gas is fed to a membrane filter unit, thereby to establish a desired ratio between said CO and said $H_2$.

19. The process of claim 16 wherein said purified gas is fed to a shift converter.

* * * * *